US006886545B1

(12) United States Patent
Holm

(10) Patent No.: US 6,886,545 B1
(45) Date of Patent: May 3, 2005

(54) CONTROL SCHEME FOR EXHAUST GAS CIRCULATION SYSTEM

(75) Inventor: Lars Thomas Holm, Knivsta (SE)

(73) Assignee: Haldex Hydraulics AB (SE)

( * ) Notice: Subject to any disclaimer, the term of this patent is extended or adjusted under 35 U.S.C. 154(b) by 0 days.

(21) Appl. No.: 10/794,609

(22) Filed: Mar. 5, 2004

(51) Int. Cl.[7] ..... F02M 25/07
(52) U.S. Cl. ..... 123/568.21; 701/108
(58) Field of Search ..... 123/568.21–568.29, 123/568.11; 701/108

(56) References Cited

U.S. PATENT DOCUMENTS

| | | | | | |
|---|---|---|---|---|---|
| 4,142,493 | A | | 3/1979 | Schira et al. | 123/119 |
| 4,174,027 | A | | 11/1979 | Nakazumi | 192/84 |
| 4,224,912 | A | | 9/1980 | Tanaka | 123/568 |
| 4,433,666 | A | * | 2/1984 | Masaki et al. | 123/568.22 |
| 5,611,204 | A | | 3/1997 | Radovanovic et al. | 60/605.2 |
| 6,182,644 | B1 | * | 2/2001 | Kotwicki et al. | 123/568.16 |
| 6,367,256 | B1 | * | 4/2002 | McKee | 123/568.12 |
| 6,502,556 | B2 | * | 1/2003 | Wienand et al. | 123/568.21 |
| 6,601,387 | B2 | * | 8/2003 | Zurawski et al. | 123/568.21 |
| 6,659,090 | B2 | * | 12/2003 | Sisken | 123/568.11 |
| 6,681,171 | B2 | * | 1/2004 | Rimnac et al. | 123/568.22 |
| 6,725,848 | B2 | * | 4/2004 | Ramamurthy et al. | 123/568.22 |
| 2004/0099257 | A1 | * | 5/2004 | Berggren et al. | 123/568.17 |

* cited by examiner

*Primary Examiner*—Noah P. Kamen
*Assistant Examiner*—Arnold Castro
(74) *Attorney, Agent, or Firm*—St. Onge Steward Johnston & Reens LLC

(57) ABSTRACT

A control system for controlling an exhaust gas recirculation system having a control valve is provided. The control system includes at least one flow sensor sensing a flow rate of at least one of a recirculating exhaust gas, an inlet air and a combined result thereof, and generating a sensor signal indicative of the sensed flow rate. A processor in communication with the at least one flow sensor receives the sensor signal indicative of the sensed flow rate and generates a control signal based at least in part upon the received sensor signal. The control valve of the exhaust gas recirculation system is adapted to be in communication with the processor and to receive the control signal therefrom, and is adapted to actuate based at least in part upon the control signal.

18 Claims, 3 Drawing Sheets

CONTROL SCHEME FOR EXHAUST GAS CIRCULATION SYSTEM

FIELD OF THE INVENTION

The present invention relates generally to exhaust gas recirculation in internal combustion engines, and more particularly is concerned with a control system for controlling the quantity of exhaust gas recirculation which is effected during the operation of an internal combustion engine.

BACKGROUND OF THE INVENTION

It is generally recognized that the production of noxious oxides of nitrogen ($NO_x$) which pollute the atmosphere are undesirable and in many cases are controlled by limits established by local, state and federal governmental regulations. The formation of $NO_x$ constituents in the exhaust gas products of an internal combustion engine must therefore be eliminated, minimized or at least maintained below some threshold limit or level.

It is generally understood that the presence of $NO_x$ In the exhaust of internal combustion engines is determined by combustion temperature and pressure as well as by the air/fuel ratio (lambda). An increase in combustion temperature causes an increase in the amount of $NO_x$ present in the engine exhaust. It is, therefore, desirable to control the combustion temperature in order to limit the amount of $NO_x$ present in the exhaust of an internal combustion engine.

One method suggested by the prior art for limiting or controlling the combustion temperature has been to recirculate a portion of the exhaust gas back to the engine air intake. It was reasoned in these early methods that since the exhaust gas is low in oxygen, this will result in a dilute combustion mixture which will burn at a lower temperature. The lower combustion temperature it was reasoned would, in turn, reduce the amounts of $NO_x$ produced during combustion.

Similarly, it had, until recently, been common practice to run an internal combustion engine at or near an ignition timing which produces peak combustion pressures which maximize combustion efficiency. However, unacceptably high levels of $NO_x$ may be produced in the combustion chambers when the engine operates at or near such conditions. In order to inhibit the formation and emission of $NO_x$ it is therefore desirable to limit the peak combustion pressure to a threshold value.

One technique suggested by the prior art for limiting combustion pressure involves the recirculation of exhaust gases through the induction passage of the combustion chamber since it is well-known that an increase in recirculation of exhaust gases will reduce peak combustion pressure and thus the attendant levels of undesirable $NO_x$.

Therefore, it has become generally well-known that the formation of undesirable oxides of nitrogen may be reduced by recirculating a portion of the exhaust gas back to the engine air/fuel intake passage so as to dilute the incoming air/fuel mixture with inert $H_2O$, and $CO_2$. The molar specific heat of these gases and especially of $CO_2$ absorbs substantial thermal energy so as to lower peak cycle temperatures and/or pressures to levels conducive to reducing $NO_x$ formation.

While $NO_x$ formation is known to decrease as the exhaust gas recirculation (EGR) flow increases to where it represents a threshold percentage of the exhaust gas constituents, it is also known that this is accompanied by a deterioration in engine performance including, but not limited to, an increase in engine roughness with increasing EGR. Therefore, one factor limiting the magnitude of EGR is the magnitude of EGR-induced performance deterioration or roughness that can be tolerated before vehicle drivability becomes unacceptable.

Early prior art attempts at solving these problems as well as other problems, such as complying with emission legislation which regulates other substances (e.g. smoke or particulate matter emissions) in addition to $NO_x$, have employed various relatively simple mechanical schemes for directly controlling the position of an EGR control valve which may be operated by sensing a parameter such as throttle position, intake manifold pressure, exhaust back pressure, the air/fuel ratio, oxygen content, etc. Such early attempts to control EGR mechanically by sensing and shaping signals indicative of a parameter of engine performance or sensing engine flow as a function of venturi vacuum or exhaust back pressure, however, are not conducive to accuracy or programmability.

Several attempts have been made to obviate the problems of such simple mechanical control schemes. U.S. Pat. No. 4,174,027 to Nakazumi represents one such attempt. In accordance with this patent, an engine has a duct connecting gases in an exhaust gas crossover passage to an intake manifold. A flow control valve is provided for controlling the flow in the duct such that the valve is moved to an open position in response to control signals generated by a processor based upon input signals received from both a clutch-actuation detection device and a throttle valve-opening detection device. Once moved to the open position, the valve is kept in the open position for a predetermined time period as controlled by an electronic timer circuit.

U.S. Pat. No. 4,224,912 to Tanaka discloses an internal combustion engine which incorporates an exhaust gas recirculation system which has an exhaust gas recirculation flow control valve provided at a middle position of the exhaust gas recirculation passage, the control valve being operated in response to electronic signals generated by a processor depending upon a comparison between target and actual values of a vacuum pressure in a diaphragm chamber. An auxiliary valve is provided in the exhaust gas recirculation passage in series with the exhaust gas recirculation flow control valve so as to control the cross-sectional area of the exhaust gas recirculation passage in accordance with the opening amount of the throttle valve provided in the intake passage of the engine.

U.S. Pat. No. 4,142,493 to Schira et al. discloses a dosed loop EGR control system for an internal combustion engine having an intake system, an exhaust system, a throttle disposed within the intake system for controlling air flow therein, and a conduit coupling the exhaust system to the intake system for supplying exhaust gas back to the intake system. The EGR control system includes a first memory pre-programmed with a look-up table of optimal EGR values indicative of EGR valve position determined as a function of engine speed and throttle position and a second memory pre-programmed with the look-up table of optimal EGR values determined as a function of engine speed and absolute manifold pressure. The actual operating parameters of engine speed, throttle position and absolute manifold pressure are sensed and used by a processor to calculate control signals which are used to adjust the position of the EGR valve at a next scheduled valve adjustment time so as to regulate EGR flow as desired.

U.S. Pat. No. 5,611,204 to Radovanovic et al. discloses a gas flow network in combination with a highly turbocharged diesel engine for the blending of either EGR gas or blow-by gas from the crankcase vent with fresh charge air. In the diesel engine assembly which incorporates the flow network for EGR gas, a venturi conduit and control valve combination is positioned between tile intake manifold and aftercooler and is connected to a flow line carrying the EGR gas. When the turbocharged diesel engine assembly is configured with a flow path for blow-by gas, the venturi and control valve combination is positioned between the intake manifold and aftercooler and is connected to a flow line carrying blow-by gas. The control valve is controlled by an electronic system which generates control signals which utilizes only throttle position as an input (e.g. a sensed condition).

While the electronic systems disclosed in each of the above-mentioned patents may provide benefits over the rudimentary mechanical control schemes which were traditionally employed, they all suffer from disadvantages. One major disadvantage of all systems is that each relies upon various indirect parameters in order to calculate or estimate the flow of recirculating exhaust gas, and then to actuate various valves based upon such indirect parameters. More specifically, U.S. Pat. No. 4,174,027 to Nakazumi utilizes clutch-actuation detection and throttle valve-opening detection as input variables to the control system, U.S. Pat. No. 4,224,912 to Tanaka utilizes a vacuum pressure in a diaphragm chamber as a control variable, U.S. Pat. No. 4,142,493 to Schira et al. utilizes either engine speed and manifold absolute pressure or engine speed and throttle position as control variables, and U.S. Pat. No. 5,611,204 to Radovanovic et al. utilizes throttle position as a control variable.

In each of these patents, a processor utilizes the measured indirect parameters in conjunction with an algorithm and/or a look-up table in order to generate control signals for controlling the flow of recirculating exhaust gas. However, a problem exists in this approach in that by controlling the flow of recirculating exhaust gas based upon indirectly measured parameters, a source of error is introduced. For example, while the formula or look-up table may be accurate when a vehicle is first manufactured, after a period of use, deposits may form, or other conditions may exist which restrict the flow of recirculating gas, fresh air or both. As such, the algorithm or look-up table may no longer accurately reflect the flows within the system. For example, while the relationship between throttle position and recirculating gas flow may be known at the time of manufacture, after use deposits may form, the engine may become worm, etc., such that at a given throttle position, there may be significantly more or less recirculating gas flow. As such, indirectly controlling recirculating gas flow based upon throttle position may no longer be effective.

A related problem is that even when vehicles are first manufactured, there are always some at least small differences between individual vehicles. As such, in order for an EGR control system which employs measured indirect parameters in conjunction with an algorithm and/or a look-up table in order to generate control signals for controlling the flow of recirculating exhaust gas to be accurate, each individual system must be calibrated in order to calculate constants employed in the algorithm and/or values stored in the look-up table after the system is installed in the particular vehicle. This may be a time and cost intensive process.

All of these problems may be obviated by employing an EGR control system which employs directly sensed flow rate as a control variable, rather than control variables which are only indirectly related to flow rate.

What is desired, therefore, is a control system for controlling an exhaust gas recirculation system which is accurate and programmable, which provides for electronic control of the exhaust gas recirculation system, which remains accurate even after extended vehicle use, which does not require re-calibration after extended vehicle use, which does not generate control signals based solely upon sensed parameters indirectly related to flow rate, and which generates control signals based at least in part on sensed fluid flow.

SUMMARY OF THE INVENTION

Accordingly, it is an object of the present invention to provide a control system for controlling an exhaust gas recirculation system which is accurate and programmable.

Another object of the present invention is to provide a control system for controlling an exhaust gas recirculation system having the above characteristics and which provides for electronic control of the exhaust gas recirculation system.

A further object of the present invention is to provide a control system for controlling an exhaust gas recirculation system having the above characteristics and which remains accurate even after extended vehicle use.

Still another object of the present invention is to provide a control system for controlling an exhaust gas recirculation system having the above characteristics and which does not require re-calibration after extended vehicle use.

Yet a further object of the present invention is to provide a control system for controlling an exhaust gas recirculation system having the above characteristics and which does not generate control signals based solely upon sensed parameters indirectly related to flow rate.

Still yet another object of the present invention is to provide a control system for controlling an exhaust gas recirculation system having the above characteristics and which generates control signals based at least in part on sensed fluid flow.

These and other objects of the present invention are achieved in one embodiment of the present invention by provision of a control system for controlling an exhaust gas recirculation system having a control valve. The control system includes at least one flow sensor sensing a flow rate of at least one of a recirculating exhaust gas, an inlet air and a combined result thereof, and generating a sensor signal indicative of the sensed flow rate. A processor in communication with the at least one flow sensor receives the sensor signal indicative of the sensed flow rate and generates a control signal based at least in part upon the received sensor signal. The control valve of the exhaust gas recirculation system is adapted to be in communication with the processor and to receive the control signal therefrom, and is adapted to actuate based at least in part upon the control signal.

In some embodiments, the control signal is based at least in part upon a deviation of the sensed flow rate from a desired flow rate.

In some embodiments, the control system also includes at least one additional sensor sensing an additional parameter of at least one of the recirculating exhaust gas, the inlet air and the combined result thereof, and generating a sensor signal indicative of the sensed additional parameter. In these embodiments, the processor receives the sensor signal indicative of the sensed additional parameter and generates the control signal based at least in part upon both the received sensor signal indicative of the flow rate and the received sensor signal indicative of the sensed additional parameter. In certain of these embodiments, the additional parameter comprises at least one of a temperature, a pressure, an oxygen concentration, a $NO_x$ concentration, a concentration of some other component (e.g., carbon dioxide, carbon monoxide, particulate matter, etc.) or the like.

In some embodiments the control system also includes at least one additional sensor sensing at least one ambient parameter, and generating a sensor signal indicative of the sensed ambient parameter. In these embodiments, the processor receives the sensor signal indicative of the sensed ambient parameter and generates the control signal based at least in part upon both the received sensor signal indicative of the flow rate and the received sensor signal indicative of the sensed ambient parameter. In certain of these embodiments, the ambient parameter comprises at least one of a temperature, a pressure, a humidity, a position of the control valve, etc.

In some embodiments, the control valve comprises a valve body arranged to be displaced in a longitudinal direction in order to achieve a variable venturi effect and to control a proportion of recirculating exhaust gas versus air in a combined result thereof, and an actuator which displaces the valve body in the longitudinal direction in response to the control signal.

In accordance with another embodiment of the present invention, an exhaust gas recirculation system comprises an inlet air supply line, a recirculating exhaust gas supply line, and an output line, with air entering through the inlet air supply line and exhaust gas entering though the recirculating exhaust gas supply line mixing to create a mixture of air and exhaust gas before exiting the output line. A control valve is actuatable to control a proportion of air versus recirculating exhaust gas in the mixture, and at least one flow sensor senses a flow rate of at least one of the air flowing through the inlet air supply line, the recirculating exhaust gas flowing through the recirculating exhaust gas supply line, and the mixture of air and exhaust gas flowing through the output line, and generates a sensor signal indicative of the sensed flow rate. A processor in communication with the at least one flow sensor and with the control valve, receives the sensor signal indicative of the sensed flow rate and generates a control signal based at least in part upon the received sensor signal, the control signal being communicated to the control valve. The control valve actuates in order to control a proportion of air versus recirculating exhaust gas in the mixture based at least in part upon the control signal.

In some embodiments, the control signal is based at least in part upon a deviation of the sensed flow rate from a desired flow rate.

In some embodiments, the system further includes at least one additional sensor sensing an additional parameter of at least one of the air flowing through the inlet air supply line, the recirculating exhaust gas flowing through the recirculating exhaust gas supply line, and the mixture of air and exhaust gas flowing through the output line, and generating a sensor signal indicative of the sensed additional parameter. In these embodiments, the processor receives the sensor signal indicative of the sensed additional parameter and generates the control signal based at least in part upon both the received sensor signal indicative of the flow rate and the received sensor signal indicative of the sensed additional parameter. In certain of these embodiments, the additional parameter comprises at least one of a temperature, a pressure, an oxygen concentration and a $NO_x$ concentration.

In some embodiments, the system further includes at least one additional sensor sensing at least one ambient parameter, and generating a sensor signal indicative of the sensed ambient parameter. In these embodiments, the processor receives the sensor signal indicative of the sensed ambient parameter and generates the control signal based at least in part upon both the received sensor signal indicative of the flow rate and the received sensor signal indicative of the sensed ambient parameter. In certain of these embodiments, the ambient parameter comprises at least one of a temperature, a pressure and a humidity.

In some embodiments, the control valve comprises a valve body arranged to be displaced in a longitudinal direction in order to achieve a variable venturi effect and to control the proportion of recirculating exhaust gas versus air in the mixture of air and exhaust gas, and an actuator which displaces the valve body in the longitudinal direction in response to the control signal.

In accordance with another aspect of the present invention, a method for controlling an exhaust gas recirculation system having a control valve includes the steps of sensing a flow rate of at least one of a recirculating exhaust gas, an inlet air and a combined result thereof, generating a sensor signal indicative of the sensed flow rate, generating a control signal based at least in part upon the sensor signal indicative of the sensed flow rate, and causing the control valve to actuate based at least in part upon the control signal.

In some embodiments, the generating a control signal step comprises the step of generating a control signal based at least in part upon a deviation of the sensed flow rate from a desired flow rate.

In some embodiments, the method further includes the steps of sensing an additional parameter of at least one of the recirculating exhaust gas, the inlet air and the combined result thereof, and generating a sensor signal indicative of the sensed additional parameter. In these embodiments, the generating a control signal step comprises the step of generating a control signal based at least in part upon both the sensor signal indicative of the flow rate and the sensor signal indicative of the sensed additional parameter. In certain of these embodiments, the additional parameter comprises at least one of a temperature, a pressure, an oxygen concentration and a $NO_x$ concentration.

In some embodiments, the method further includes the steps of sensing at least one ambient parameter, and generating a sensor signal indicative of the sensed ambient parameter. In these embodiments, the generating a control signal step comprises the step of generating a control signal based at least in part upon both the sensor signal indicative of the flow rate and the sensor signal indicative of the sensed ambient parameter. In certain of these embodiments, the ambient parameter comprises at least one of a temperature, a pressure and a humidity.

In some embodiments, the control valve comprises a valve body arranged to be displaced in a longitudinal direction in order to achieve a variable venturi effect and to control a proportion of recirculating exhaust gas versus air in a combined result thereof, and the method further comprises the step of displacing the valve body in the longitudinal direction in response to the control signal.

The invention and its particular features and advantages will become more apparent from the following detailed description considered with reference to the accompanying drawings.

DETAILED DESCRIPTION OF AN EMBODIMENT OF THE INVENTION

Figure 1:
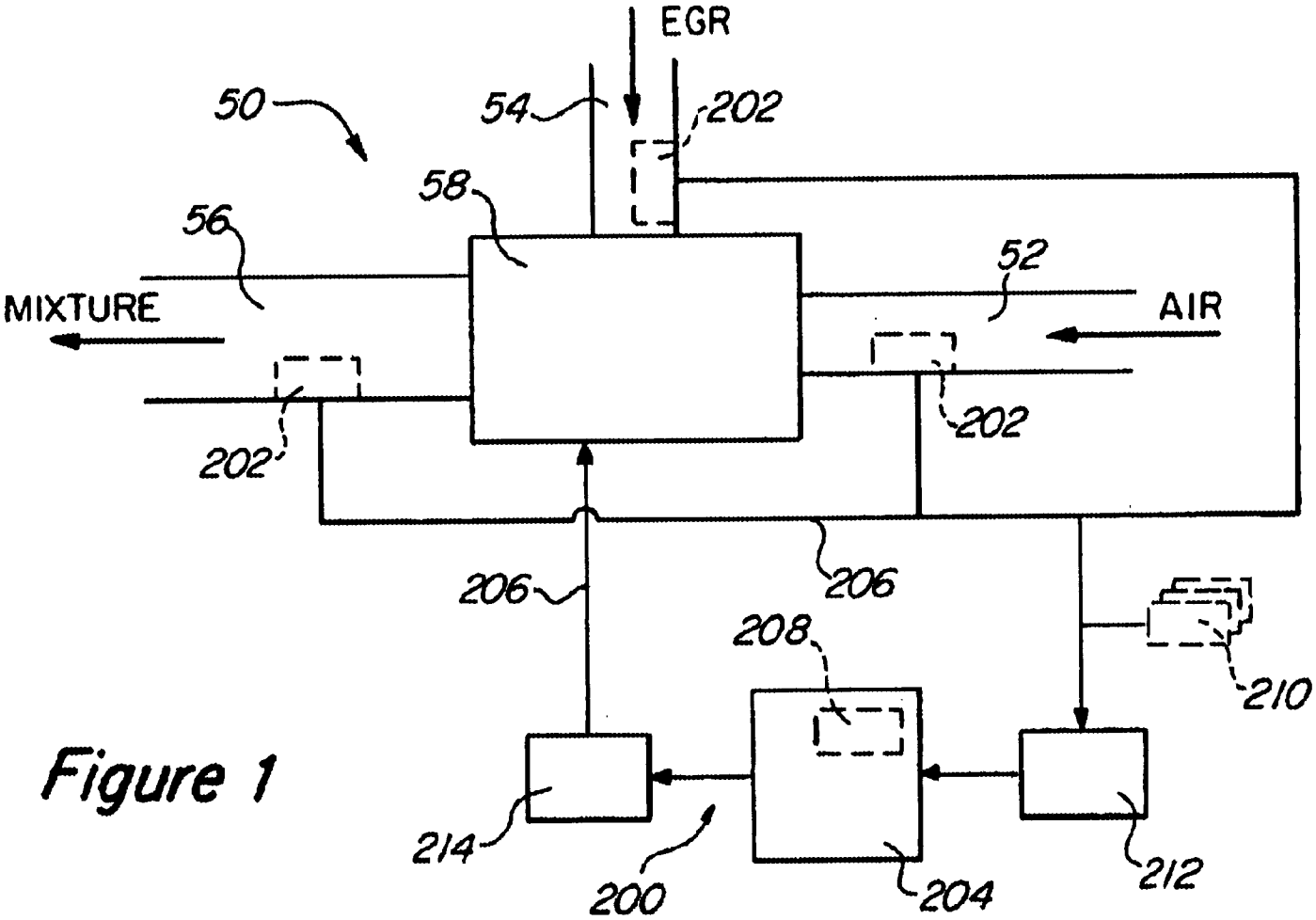
FIG. 1 is a schematic view of a control system in accordance with the present invention shown controlling an exhaust gas recirculation system

Referring first to FIG. 1, an exhaust gas recirculation (EGR) system 50 is schematically shown. System 50 includes an inlet air supply line 52, a recirculating exhaust gas supply line 54, and an output line 56, with air entering through the inlet air supply line 52 and exhaust gas entering though the recirculating exhaust gas supply line 54 mixing to create a mixture of air and exhaust gas before exiting the output line 56. A control valve 58 is actuatable to control a proportion of air versus recirculating exhaust gas in the mixture.

Figure 2:
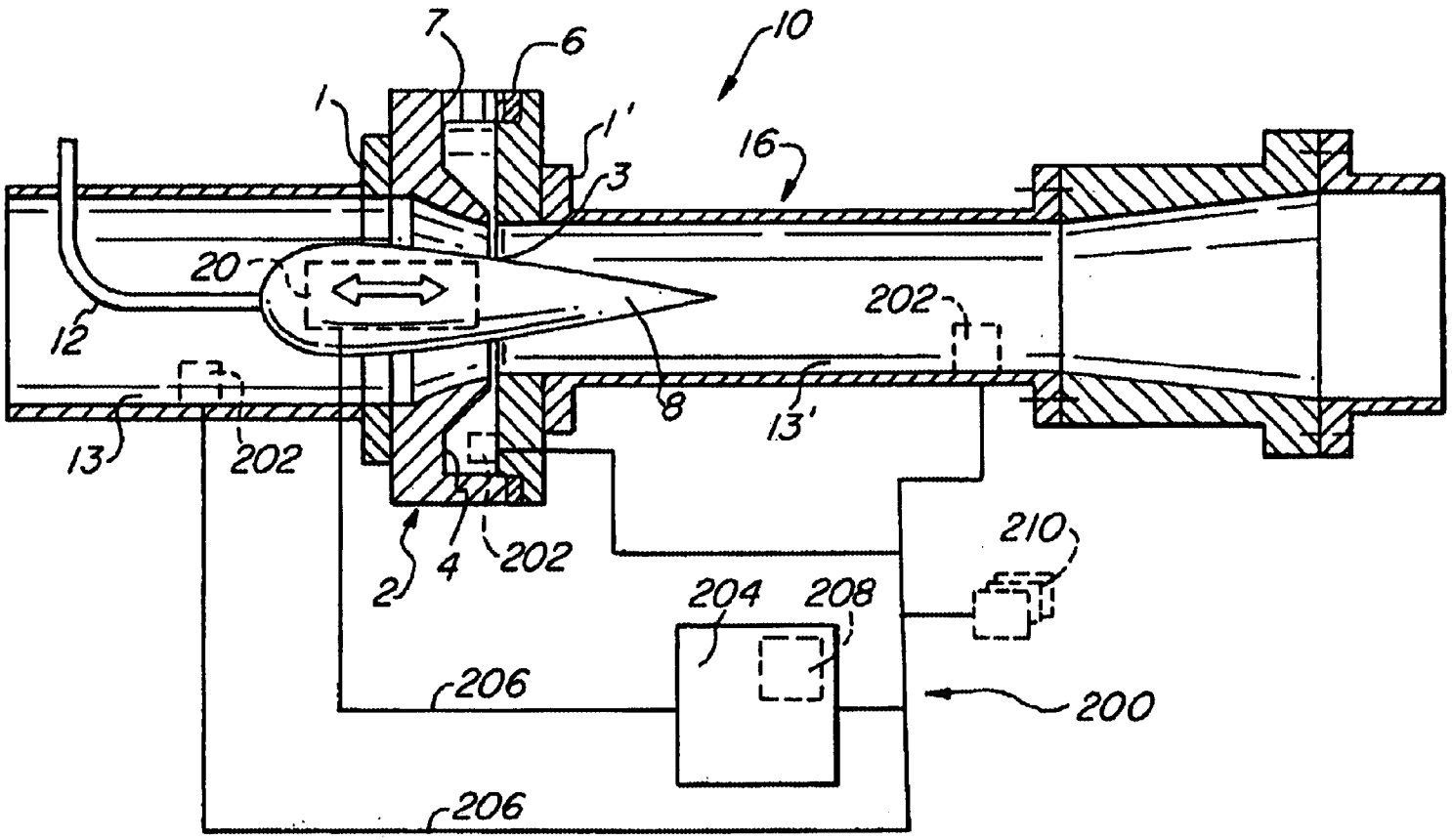
FIG. 2 is a partially cross-sectional and partially schematic view of the control system of FIG. 1 shown controlling an exemplary exhaust gas recirculation system.
Figure 3:
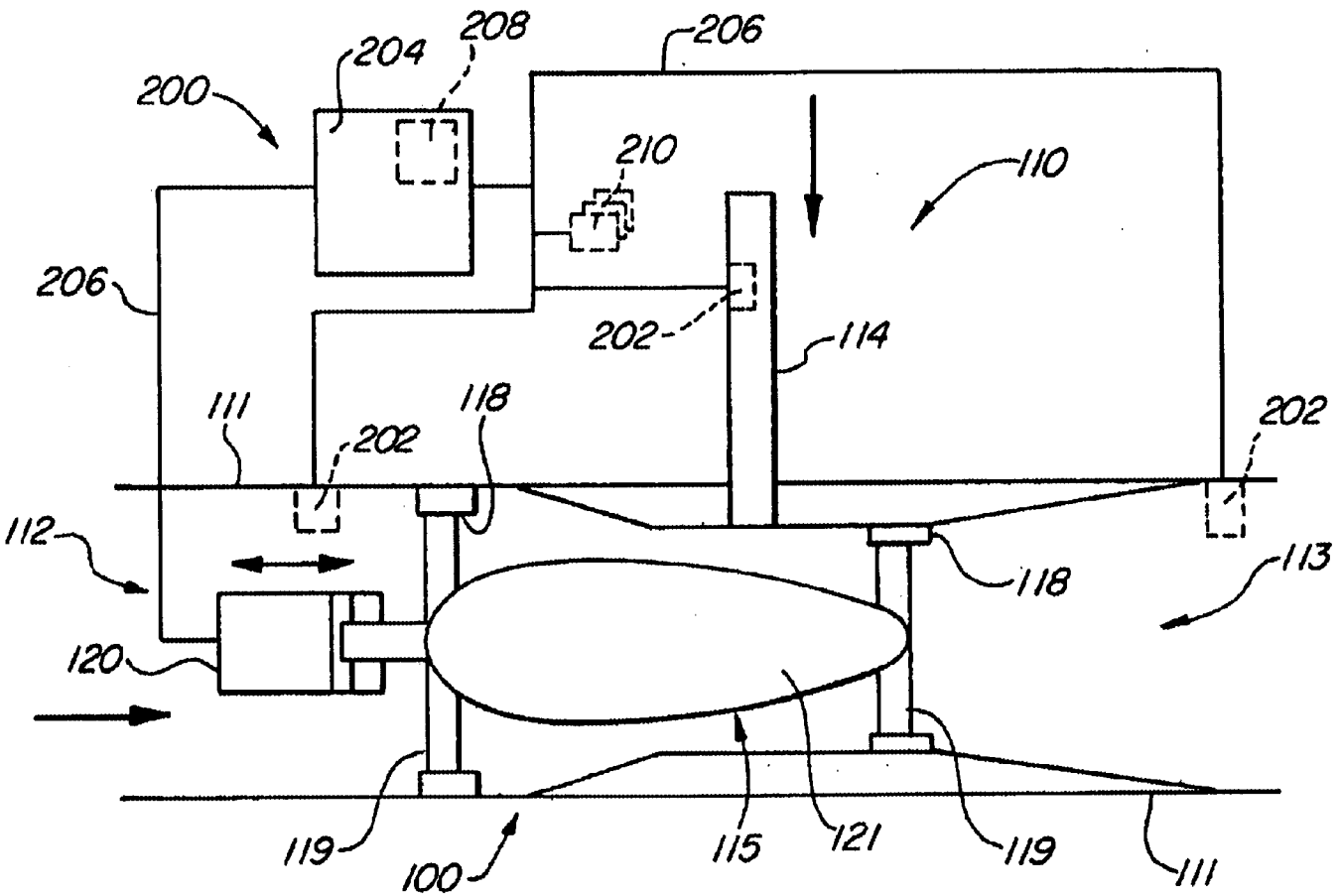
FIG. 3 is a partially cross-sectional and partially schematic view of the control system of FIG. 1 shown controlling another exemplary exhaust gas recirculation system.

Referring now to FIGS. 2 and 3, two more specific examples of exhaust gas recirculation systems are shown. It should be understood that the control system of the present invention may be used with any of numerous exhaust gas recirculation systems, with the exemplary systems shown in FIGS. 2 and 3 being used for illustration purposes only.

Referring specifically to FIG. 2, exhaust gas recirculation (EGR) system 10 includes an exhaust gas recirculation supply flow introduced radially via a supply part 2 into a channel or pipeline generally denoted by 16 from a turbocharger (not shown). Supply part 2 thus comprises a recirculating exhaust gas supply line through which exhaust gas is introduced.

The supply part 2 is inserted between flanges 1, 1' of a pair of pipe sections 13 and 13' in the line 16. Pipe section 13 comprises an inlet air supply line through which (typically fresh) air is introduced, while pipe section 13' comprises an output line through which a mixture of air and exhaust gas exits after being mixed as described more fully below. The supply part 2 forms a flow regulator together with a streamlined body 8 more fully described below.

On the basis of the designs of the streamlined body 8 and the supply part 2, the greatest throttling of fresh air is always achieved at the gap 3 for exhaust gas introduction, independently of the position of the body 8. In the embodiment shown, the supply part 2 is designed with a cross-sectional area that decreases up to the slit in the direction of flow in the line 16 for this purpose. This reduction in the cross-sectional area of the supply part 2 is, furthermore, greater than the reduction in the cross-sectional area of the streamlined body 8 downstream of its greatest cross-sectional area in the direction of flow in the line 16. In the active diffuser region downstream of the gap 3, the line 16 has, in the embodiment shown, a constant cross-sectional area, while the cross-sectional area of the streamlined body 8 continues to decrease in this region. An actuator 20 is arranged such that the greatest cross-sectional area of the streamlined body 8 is never displaced downstream of the gap 3.

The ring-shaped channel that is defined between the supply part 2 and the streamlined body 8 thus always has a convergent course in the direction of flow up to the gap 3 and a divergent course after the gap 3 independently of the position of the body 8.

Supply flow preferably occurs via the continuous circular gap 3 through the supply part 2, which in this case is in two parts. However, introduction of exhaust gas can also be achieved via a number of holes or slits around the perimeter (not shown).

Even if the supply occurs radially, the direction of the supply at the inlet 7 of the supply part 2 can be selected to lie at such an angle that the desired flow conditions and the least possible flow losses can be achieved when mixing the two gases.

By maximizing the throttling of fresh air at the inlet of exhaust gases 7 according to the invention, the greatest possible pump effect is also achieved, that is, the solution involves very small pressure losses. As a consequence of the free flow of air around the present streamlined body 8, which displays a venturi effect in itself, deterioration of the power of the engine is avoided in the same way while good regulation of the EGR supply is achieved.

A continuous, cylindrical cavity 4 exists around the gap 3. A gasket 6 is placed between the two portions of the supply part 2. The desired gap distance in the gap 3 can be achieved by selecting the thickness of the gasket 6. A supply pipe for the EGR supply flow can be mounted in a manner that is not shown at the inlet 7 of the supply part 2 from an extension of a manifold for the exit exhaust gases of the engine.

The input air is cooled in the conventional manner downstream of the turbocharger by an intercooler that is not shown, and the EGR gases are cooled in the same way via a separate EGR cooler before supply into the inlet channel. A flow regulator can be placed at a freely chosen location downstream of the turbocharger. However, the flow regulator is preferably located downstream of the intercooler to prevent the latter being contaminated with soot or being corroded by the acidic exhaust gases.

The streamlined body 8 is freely suspended within the supply part 2 by means of a holder 12 that extends from the front edge of the body 8 and outwards into the pipe section 13. The actuator 20 for displacement of the body 8 forwards and backwards relative to the supply part 2 can, according to the invention, be arranged either within the body 8 or outside of the line 16. In the embodiment according to FIG. 2, the holder 12 is attached to the outer wall of the pipe section 13 and comprises a feed line for regulation of the actuator 20.

The actuator 20 can be regulated by hydraulic means or through a gaseous fluid, preferably pressurized air, that is available on commercial vehicles through the braking system. In the embodiment shown in FIG. 2, the actuator 20 is integrated with the body 8, that is, it is located inside of it. Thus the streamlined body 8 can be displaced forwards and backwards relative to the gap 3 within the supply part 2 by variation of the fluid pressure in the feed line 12.

Thus, various parts of system 10, in particular streamlined body 8, define a control valve actuatable to control a proportion of air versus recirculating exhaust gas in the mixture.

Referring now to FIG. 3, another exhaust gas recirculation system 100 having a variable area of venturi design is illustrated. Venturi arrangement 110 is positioned in a flow line 111 with an intake side 112 (which comprises an inlet air supply line through which (typically fresh) air is introduced) and an exit flow side 113 (which comprises an output line through which a mixture of air and exhaust gas exits after being mixed as described more fully below). The EGR flow line 114 (which comprises a recirculating exhaust gas supply line through which exhaust gas is introduced) intersects the flow line 111 as illustrated. Tile point of intersection is at a narrowed portion 115 of flow line 111; the narrowing being achieved by the placement of a narrowing sleeve in the flow line 111. The remainder of venturi arrangement 110 includes guide rings 118, struts 119, actuator 120 and centerbody 121.

Centerbody 121 which is aerodynamically smooth is positioned within the slight area reduction section (portion 115) and is moveable axially relative to the area reduction section. The static pressure at the venturi throat is controlled by changing the venturi area via tile centerbody position. The centerbody 121 is held by struts 119 to guide rings 118 which keep the centerbody in the center of the tube. The rear guide ring is used as a shut-off valve. The controlling actuator is located in the clean, up stream air.

Thus, various parts of system 100, in particular centerbody 121, define a control valve actuatable to control a proportion of air versus recirculating exhaust gas in the mixture.

Referring now to all of FIGS. 1–3, a control system 200 in accordance with the present invention is shown in conjunction with controlling an exhaust gas recirculation system 50, 10, 100. Control system 200 includes at least one flow sensor 202 sensing a flow rate of at least one of the air flowing through the inlet air supply line 52, 13, 112, the recirculating exhaust gas flowing through the recirculating exhaust gas supply line 54, 2, 114, and the mixture of air and exhaust gas flowing through the output line 56, 13', 113. Flow sensors 202 are shown in dashed lines in order to indicate that only one of the three flow sensors 202 shown in each Figure is required. Of course, if desired two of the shown flow sensors 202 or all three of the flow sensors 202 may be provided. Flow sensor(s) 202 generate a sensor signal 212 indicative of the sensed flow rate.

As is known in the art, there are generally three basic types of flow sensors. Mass flow sensors measure flow rate in terms of the mass of the fluid substance and have units such as lbs/min. Volumetric flow sensors measure flow rate in terms of how much of the material is flowing and use units like mL/min. Velocity flow sensors measure flow rate as in terms of how fast the material is moving—these use units like ft/sec. As such flow sensors are known, operation of such is not described herein in detail. However, it should be noted that any of the three types of flow sensors (or any other type of flow sensor) may be employed in the present invention.

Control system 200 also includes a processor 204 in communication with the flow sensor(s) 202 and with the control valve 58 (more specifically in the examples shown in FIGS. 2 and 3, with the actuator 20, 120 thereof) via one or more communications links 206. Processor 204 may comprise a digital processor, an analog processor, or a hybrid of both, and may be embodied in hardware, software, firmware, etc., it being understood that the precise configuration of processor 204 is unimportant so long as processor 204 is capable of performing the operations discussed herein. A single communication link may be provided for connecting all sensors and the control valve to the processor, two separate communications links may be provided (e.g., one for connecting the sensors to the processor and another for connecting the control valve to the processor) as shown in the Figures, or multiple communications links may be provided. In certain circumstances it has been found that configuring communications link(s) 206 as a control area network (CAN) bus or as part of a CAN bus is desirable.

Processor 204 receives the sensor signal 212 indicative of the sensed flow rate and generates a control signal 214 based at least in part upon the received sensor signal 212. The control signal 214 is communicated to the control valve 58 (e.g., to actuator 20, 120) via communications link(s) 206, and the control valve 58 actuates (e.g., actuator 20, 120 causes streamlined body 8 or centerbody 121 to move) in order to control a proportion of air versus recirculating exhaust gas in the mixture based at least in part upon the control signal 214 as more fully described above.

Processor 204 may use any of numerous means in order to generate the control signal 214, such as by way of illustration but not limitation, using a formula or algorithm, or by employing a look-up table or the like. In some cases, it may be desirable to provide processor with some type of memory 208 in order that formulas, algorithms, tables, etc. may be stored. In one specific example, processor 204 may generate the control signal 214 based at least in part upon a deviation of the sensed flow rate from a desired flow rate. In this case, it may be desirable to store the desired flow rate in memory 208. In some cases, the desired flow rate may comprise a static value. In other cases, the desired flow rate may change depending upon operating conditions, and itself may be calculated based upon a formula or algorithm, or retrieved from a look-up table.

The sensed flow rate may comprise the only control variable used to generate the control signal, or may comprise only one of a plurality of control variables used to generate the control signal. For example, control system 200 may include at least one additional sensor 210 which senses various additional parameters and generates and transmits to processor 204 sensor signals indicative of such additional parameters. For example, additional sensor(s) 210 may be provided for sensing an additional parameter of at least one of the air flowing through the inlet air supply line, the recirculating exhaust gas flowing through the recirculating exhaust gas supply line, and the mixture of air and exhaust gas flowing through the output line. The additional parameter may comprise, for example at least one of a temperature, a pressure, an oxygen concentration, a $NO_x$ concentration, a carbon dioxide concentration, a carbon monoxide concentration and a particulate matter concentration of the air flowing through the inlet air supply line, the recirculating exhaust gas flowing through the recirculating exhaust gas supply line, and/or the mixture of air and exhaust gas flowing through the output line. In another example, additional sensor(s) 210 may be provided for sensing at least one ambient parameter, such as ambient temperature, pressure, humidity and/or a position of the control valve.

The present invention, therefore, provides a control system for controlling an exhaust gas recirculation system which is accurate and programmable, which provides for electronic control of the exhaust gas recirculation system, which remains accurate even after extended vehicle use, which does not require re-calibration after extended vehicle use, which does not generate control signals based solely upon sensed parameters indirectly related to flow rate, and which generates control signals based at least in part on sensed fluid flow.

Although the invention has been described with reference to a particular arrangement of parts, features and the like, these are not intended to exhaust all possible arrangements or features, and indeed many other modifications and variations will be ascertainable to those of skill in the art

What is claimed is:

1. A control system for controlling an exhaust gas recirculation system having a control valve, said control system comprising:

a processor for receiving a desired flow rate of at least one of a recirculating exhaust gas, an inlet air and a combined result thereof;

at least one flow sensor sensing a flow rate of the fluid for which the processor receives the desired flow rate, and generating a sensor signal indicative of the sensed flow rate;

wherein the processor is in communication with said at least one flow sensor, said processor receiving the sensor signal indicative of the sensed flow rate and generating a control signal based at least in part upon a deviation of the sensed flow rate from the desired flow rate; and wherein the control valve of the exhaust gas recirculation system is adapted to be in communication with said processor and to receive the control signal therefrom, and is adapted to adjust the proportion air versus recirculating exhaust gas based at least in part upon the control signal.

2. The control system of claim 1 further comprising:

at least one additional sensor sensing an additional parameter of at least one of the recirculating exhaust gas, the inlet air and the combined result thereof, and generating a sensor signal indicative of the sensed additional parameter; and wherein the processor receives the sensor signal indicative of the sensed additional parameter and generates the control signal based at least in part upon both the received sensor signal indicative of the flow rate and the received sensor signal indicative of the sensed additional parameter.

3. The control system of claim 2 wherein the additional parameter comprises at least one of a temperature, a pressure, an oxygen concentration, a $NO_x$ concentration, a carbon dioxide concentration, a carbon monoxide concentration and a particulate matter concentration.

4. The control system of claim 1 further comprising:

at least one additional sensor sensing at least one ambient parameter, and generating a sensor signal indicative of the sensed ambient parameter; and wherein the processor receives the sensor signal indicative of the sensed ambient parameter and generates the control signal based at least in part upon both the received sensor signal indicative of the flow rate and the received sensor signal indicative of the sensed ambient parameter.

5. The control system of claim 3 wherein the ambient parameter comprises at least one of a temperature, a pressure, a humidity and a position of the control valve.

6. The control system of claim 1 wherein the control valve comprises:

a valve body arranged to be displaced in a longitudinal direction in order to achieve a variable venturi effect and to control a proportion of recirculating exhaust gas versus air in a combined result thereof; and an actuator which displaces the valve body in the longitudinal direction in response to the control signal.

7. An exhaust gas recirculation system comprising:

an inlet air supply line, a recirculating exhaust gas supply line, and an output line, air entering through the inlet air supply line and exhaust gas entering though the recirculating exhaust gas supply line mixing to create a mixture of air and exhaust gas before exiting the output line;

a control valve actuatable to control a proportion of air versus recirculating exhaust gas in the mixture;

a processor for receiving a desired flow rate of at least one of the air flowing through the inlet air supply line, the recirculating exhaust gas flowing through the recirculating exhaust gas supply line, and the mixture of air and exhaust gas flowing through the output line;

at least one flow sensor sensing a flow rate of the fluid for which the processor receives the desired flow rate, said at least one flow sensor generating a sensor signal indicative of the sensed flow rate;

wherein the processor is in communication with said at least one flow sensor and with said control valve, said processor receiving the sensor signal indicative of the sensed flow rate and generating a control signal based at least in part upon a deviation of the sensed flow rate from the desired flow rate, the control signal being communicated to said control valve; and wherein said control valve actuates in order to control a proportion of air versus recirculating exhaust gas in the mixture based at least in part upon the control signal.

8. The control system of claim 7 further comprising:

at least one additional sensor sensing an additional parameter of at least one of the air flowing through the inlet air supply line, the recirculating exhaust gas flowing through the recirculating exhaust gas supply line, and the mixture of air and exhaust gas flowing through the output line, and generating a sensor signal indicative of the sensed additional parameter; and wherein the processor receives the sensor signal indicative of the sensed additional parameter and generates the control signal based at least in part upon both the received sensor signal indicative of the flow rate and the received sensor signal indicative of the sensed additional parameter.

9. The control system of claim 8 wherein the additional parameter comprises at least one of a temperature, a pressure, an oxygen concentration, a $NO_x$ concentration, a carbon dioxide concentration, a carbon monoxide concentration and a particulate matter concentration.

10. The control system of claim 7 further comprising:

at least one additional sensor sensing at least one ambient parameter, and generating a sensor signal indicative of the sensed ambient parameter; and wherein the processor receives the sensor signal indicative of the sensed ambient parameter and generates the control signal based at least in part upon both the received sensor signal indicative of the flow rate and the received sensor signal indicative of the sensed ambient parameter.

11. The control system of claim 10 wherein the ambient parameter comprises at least one of a temperature, a pressure, a humidity and a position of the control valve.

12. The control system of claim 7 wherein the control valve comprises:

a valve body arranged to be displaced in a longitudinal direction in order to achieve a variable venturi effect and to control the proportion of recirculating exhaust gas versus air in the mixture of air and exhaust gas; and an actuator which displaces the valve body in the longitudinal direction in response to the control signal.

13. A method for controlling an exhaust gas recirculation system having a control valve, said method comprising the steps of:

establishing a desired flow rate of at least one of a recirculating exhaust gas, an inlet air and a combined result thereof;

sensing a flow rate of the fluid for which the desired flow rate is established;

generating a sensor signal indicative of the sensed flow rate;

generating a control signal based at least in part upon a deviation of the sensed flow rate from the desired flow rate; and causing the control valve to adjust the proportion of air versus recirculating exhaust gas based at least in part upon the control signal.

14. The method of claim 13 further comprising the steps of:

sensing an additional parameter of at least one of the recirculating exhaust gas, the inlet air and the combined result thereof;

generating a sensor signal indicative of the sensed additional parameter; and wherein said generating a control signal step comprises the step of generating a control signal based at least in part upon both the sensor signal indicative of the flow rate and the sensor signal indicative of the sensed additional parameter.

15. The method of claim 14 wherein the additional parameter comprises at least one of a temperature, a pressure, an oxygen concentration, a $NO_x$ concentration, a carbon dioxide concentration, a carbon monoxide concentration and a particulate matter concentration.

16. The method of claim 13 further comprising the steps of:

sensing at least one ambient parameter;

generating a sensor signal indicative of the sensed ambient parameter; and wherein said generating a control signal step comprises the step of generating a control signal based at least in part upon both the sensor signal indicative of the flow rate and the sensor signal indicative of the sensed ambient parameter.

17. The method of claim 16 wherein the ambient parameter comprises at least one of a temperature, a pressure, a humidity and a position of the control valve.

18. The method of claim 13 wherein the control valve comprises a valve body arranged to be displaced in a longitudinal direction in order to achieve a variable venturi effect and to control a proportion of recirculating exhaust gas versus air in a combined result thereof, and wherein said method further comprises the step of displacing the valve body in the longitudinal direction in response to the control signal.

* * * * *